US005106077A

United States Patent [19]

Kawaguchi et al.

[11] Patent Number: 5,106,077

[45] Date of Patent: Apr. 21, 1992

[54] PAPER CONVEYING, DISCHARGING AND RECOVERING MECHANISM

[75] Inventors: Isao Kawaguchi; Toshigi Matsue, both of Niigata, Japan

[73] Assignee: Hitachi, Ltd., Tokyo, Japan

[21] Appl. No.: 488,145

[22] Filed: Mar. 5, 1990

[30] Foreign Application Priority Data

Mar. 6, 1989 [JP] Japan ..... 1-51890

[51] Int. Cl.[5] ..... B65H 29/12

[52] U.S. Cl. ..... 271/302; 271/200; 271/273

[58] Field of Search ..... 271/3.1, 200, 273, 299, 271/302, 304, 902

[56] References Cited

U.S. PATENT DOCUMENTS

| | | | |
|---|---|---|---|
| 4,015,840 | 4/1977 | Schröder | 271/302 |
| 4,890,826 | 1/1990 | Rutishauser | 271/302 |
| 4,917,659 | 4/1990 | Mohaupt et al. | 271/302 |
| 4,955,964 | 9/1990 | Hain | 271/302 |

FOREIGN PATENT DOCUMENTS

| | | | |
|---|---|---|---|
| 56807 | 9/1966 | German Democratic Rep. | 271/302 |
| 126296 | 3/1949 | Japan . | |
| 20295 | 1/1985 | Japan . | |

OTHER PUBLICATIONS

Mott, W. E., "Paper Transport", *IBM Technical Disclosure Bulletin,* vol. 15, No. 7, p. 2228 (Dec. 1972).

*Primary Examiner*—Joseph E. Valenza
*Assistant Examiner*—Steven M. Reiss
*Attorney, Agent, or Firm*—Fay, Sharpe, Beall, Fagan, Minnich & McKee

[57] ABSTRACT

An automated teller machine (ATM) dispenses currency through a delivery port. Two opposing belts form a clamping unit during normal operation. Currency is clamped between the belts and the belts are rotated in a forward direction to deliver currency to the discharge port. If there is a problem with the delivery of the currency during dispensing, or a person fails to take money which has been delivered, the transportation unit pivots to change the delivery path and the belts move in a reverse direction to transport the currency to a storage area within the ATM.

20 Claims, 5 Drawing Sheets

PAPER CONVEYING, DISCHARGING AND RECOVERING MECHANISM

BACKGROUND OF THE INVENTION

The present invention relates to a paper handling mechanism and more particularly to a mechanism for conveying, discharging and recovering sheets of paper which have been fed from another portion and stacked on a tray, e.g. a mechanism in a paper-money dispensing machine (ATM) which conveys paper money to a delivery port in accordance with a command for pull back and recovery of paper money to its interior.

DESCRIPTION OF THE RELATED ART

Conventional dispensing mechanisms are known which use a fixed tray on which paper is stacked, as disclosed in Japanese Utility Model Laid-Open No. 126296/75, or which use a tilting tray, as disclosed in Japanese Patent Application No. 127605/83. The former is shown in FIG. 4 which recovers paper 14 which has been rejected from a delivery port 50. Selection belts 54 and 55 which clamp the paper 14 are moved in the direction of arrow A, thereby allowing the paper 14 to be discharged into a recovery box 56 located below the belts. In the latter mechanism, as shown in FIG. 5, a tray 61 is tilted about a pivot shaft 62, whereby the paper 14 is discharged into a recovery box 64 through a discharge belt 63.

In the former conventional mechanism referred to above, a conveyance path for the paper 14 has a front-stage conveyance path consisting of a push-in belt 52 and a receiving belt 53 and a rearstage conveyance path consisting of the selection belts 54 and 55. However, a large space is required for moving the selection belts 54 and 55 in the foregoing manner. Problems are also encountered in the latter conventional mechanism referred in above. The paper conveyance to the latter device is unstable because nothing is used to hold and restrain the paper 14 on the tray 61, and a special recovering mechanism is required because the paper discharge angle and direction are limited, resulting in the lack of design versatility.

OBJECT OF THE INVENTION

It is the object of the present invention to overcome the above-mentioned drawbacks of the prior art and provide a paper conveying, discharging and recovering mechanism which is compact and highly versatile in its layout, e.g. layout, of a paper recovery box.

SUMMARY OF THE INVENTION

The above object is attained by a paper conveying, discharging and recovering mechanism according to the present invention which clamps between opposing belts, sheets of paper that have been stacked on a tray through another conveyor, conveys the sheets of paper forward or reverse while maintaining the clamped state while and can tilt the belts as a unit while clamping the sheets of paper on the tray in a plurality of stop positions.

According to the present invention, since the recovery box mounting position is not limited by the paper discharging direction, the space occupied by the mechanism can be reduced, and because of a simplified recovery path, it is possible to reduce the size of the mechanism. Moreover, since it is possible to select a recovery method suitable for the paper conveying, discharging and recovering mechanism of the present invention, it is possible to construct this mechanism so as to have a module structure modular structure, making it economically feasible.

DESCRIPTION OF THE PREFERRED EMBODIMENTS

Figure 6:
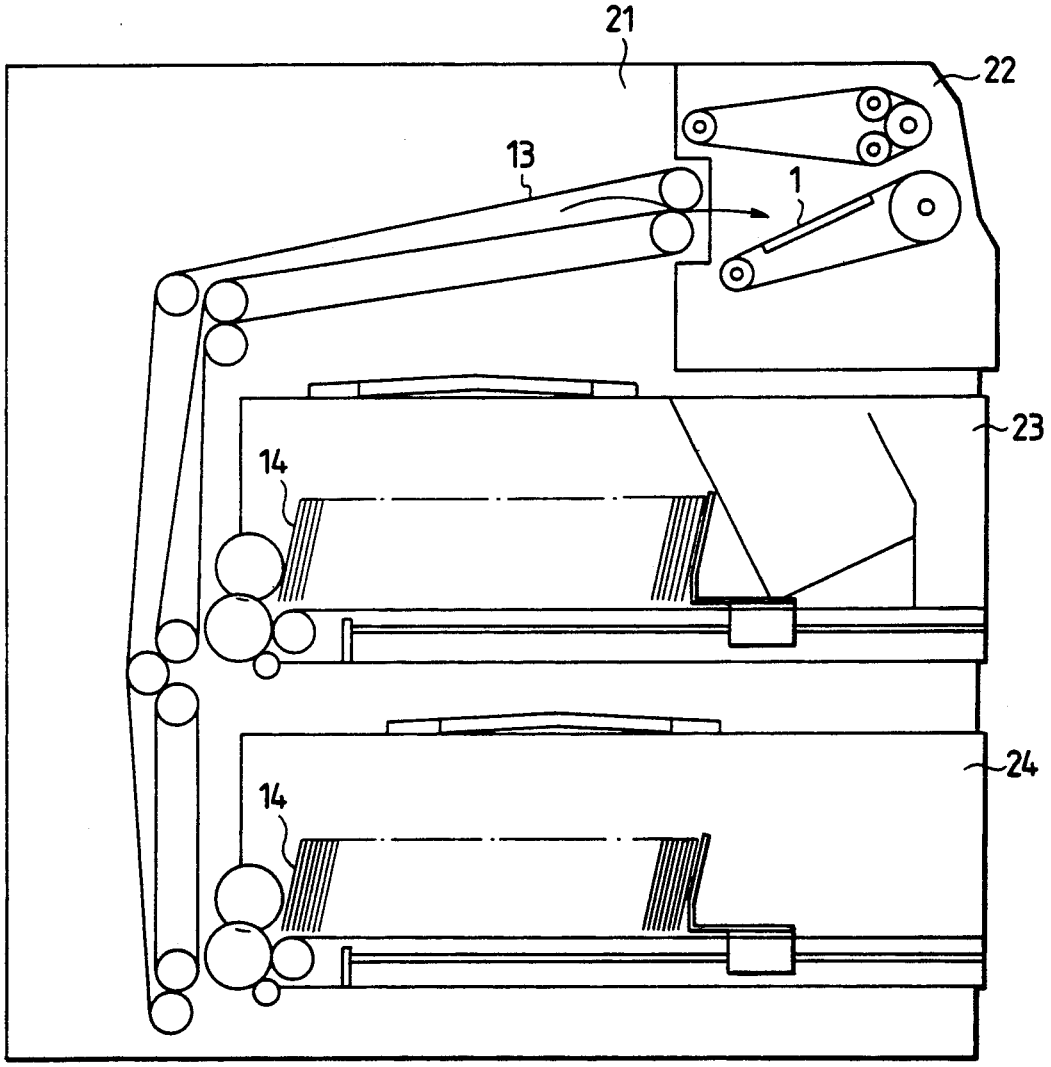
FIG. 6 is a diagram showing an entire arrangement of the paper conveying, discharging and recovering mechanism embodying the present invention.
Figure 7A:
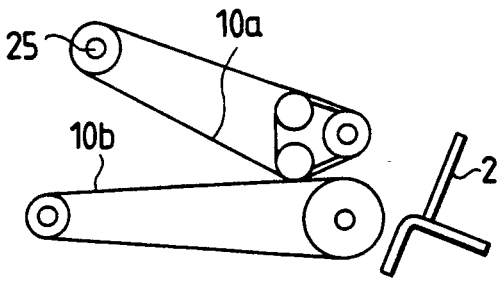
FIGS. 7(*a*)–(*e*) are diagrams showing operating conditions in accordance with an operation procedure in another embodiment of the present invention.
Figure 7B:
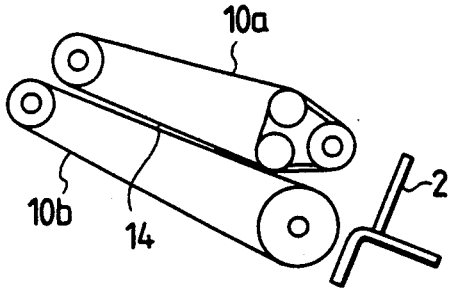
Figure 7C:
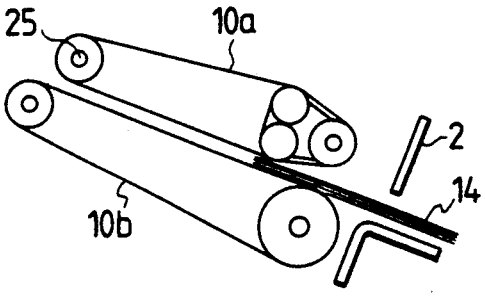
Figure 7D:
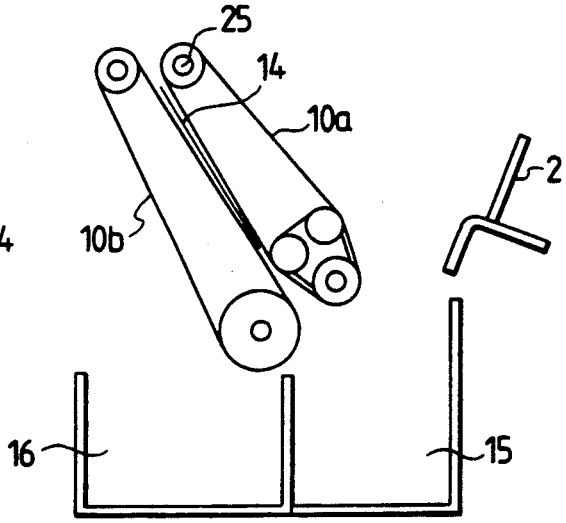
Figure 7E:
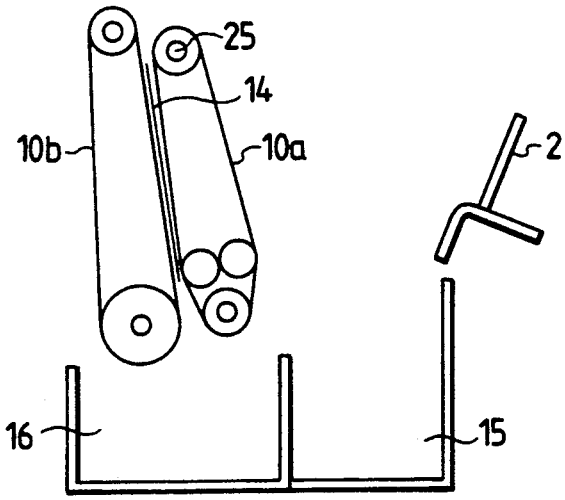

An embodiment of the present invention will now be described with reference to the drawings. FIG. 6 illustrates a mechanism for conveying, discharging and recovering paper 14, e.g. currency, according to an embodiment of the present invention. In the same figure, the numeral 23 denotes a storage box of 10,000-yen notes for example, while the numeral 24 denotes a storage box of 1,000-yen notes for example. The type of currency designated by a command signal is conveyed by a conveyor belt 13 and stacked on a tray 1. The numerals 21 and 22 denote a currency handling apparatus and a conveying, discharging and recovering portion, respectively.

Figure 1:
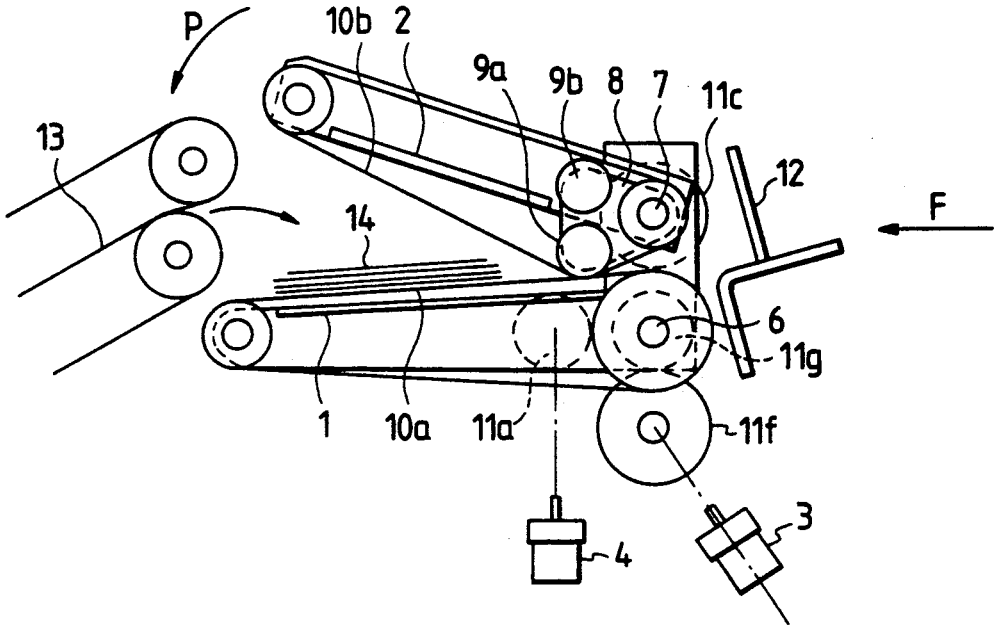
FIG. 1 is a side view of a principal portion of a paper conveying, discharging and recovering mechanism according to an embodiment of the present invention.
Figure 2:
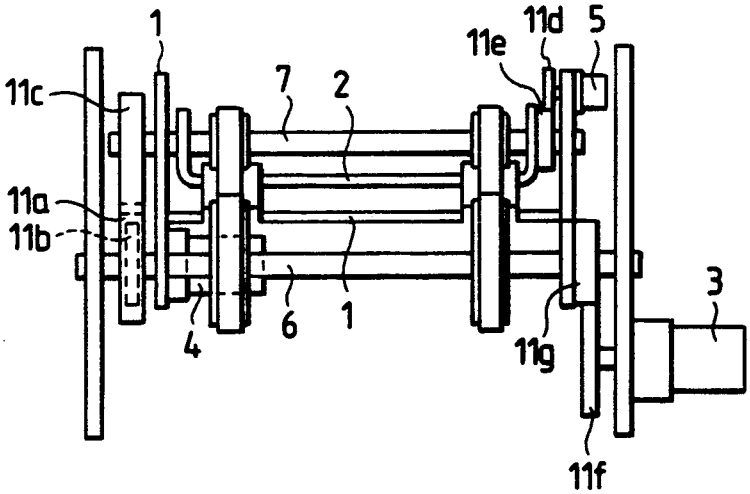
FIG. 2 is a view as seen in the direction of arrow F in FIG. 1.
Figure 3A:
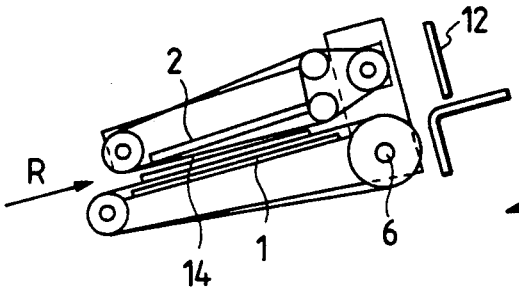
FIGS. 3(*a*)–(*d*) are diagrams showing operating conditions in accordance with an operation procedure in the embodiment of FIG. 1.
Figure 3B:
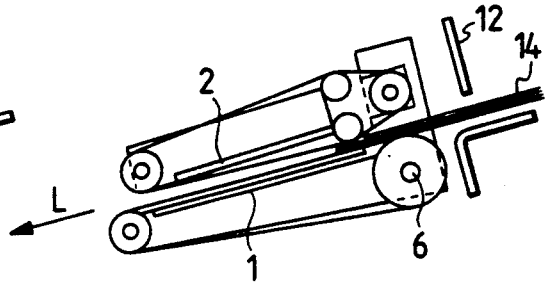
Figure 3C:
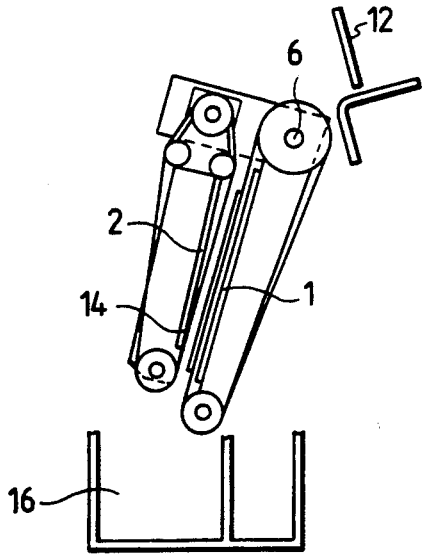
Figure 3D:
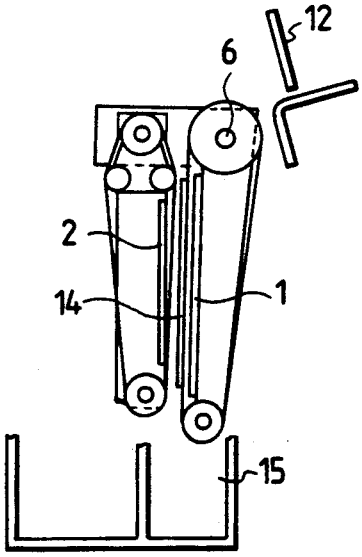
Figure 4:
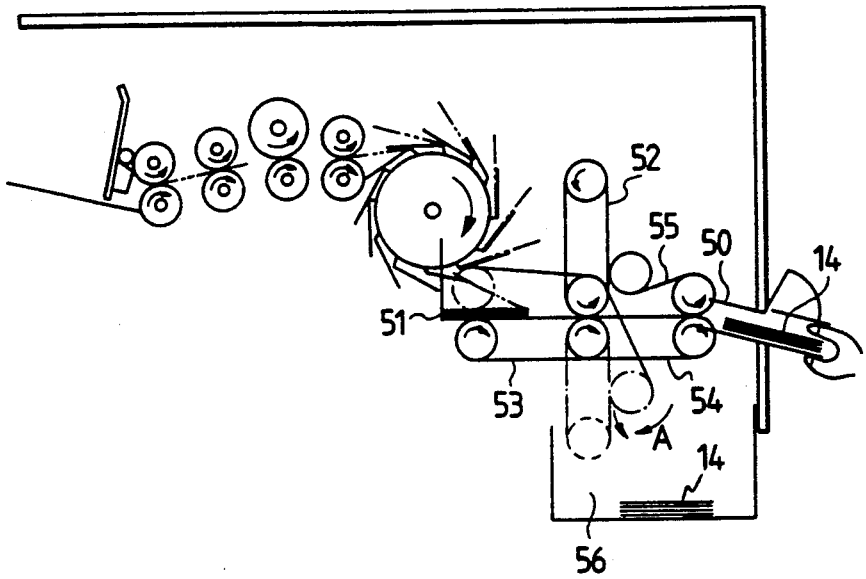
FIG. 4 PRIOR ART
FIGS. 4 and 5 are schematic construction diagrams of conventional mechanisms.
Figure 5:
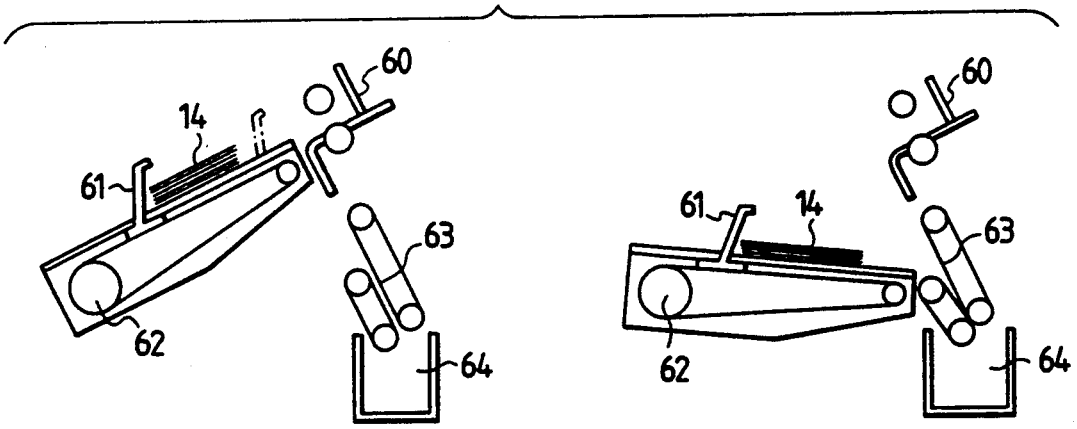
FIG. 5 PRIOR ART

FIG. 1 is a side view showing the details of a principal portion of the conveying, discharging and recovering mechanism shown in FIG. 6, and FIG. 2 is a view of the mechanism as seen in the direction of arrow F of FIG. 1 excluding delivery port 12. In the state illustrated therein, the paper 14 conveyed by the conveyor belt 13 has been received onto the tray 1. A presser 2 is mounted pivotably about a shaft 7 and is rotated by a motor 5 through gears 11*d* and 11*e*. Since the shaft 7 is held by the tray 1, the presser member 2 can maintain its positional relation with the tray. The tray 1 and the presser member 2 are provided with discharging and recovering belts 10*a*, 10*b*, respectively. Upon closing of the presser member 2, sheets of paper 14 stacked on the tray are clamped, discharged and recovered by the belts 10*a* and 10*b*. A motor 4 is fixed to the tray 1 and the driving force from this motor is transmitted to the belt 10*a* through gears 11*a*, 11*b* and 11*c*. The belt 10*b* is interlocked with the belt 10*a*. A motor 3 is rotates shaft 6 through gears 11*f* and 11*g*. With this rotation, the tray 1 tilts. The thickness of the sheets of paper 14 stacked on the tray 1 varies depending on the number of sheets of paper, but this causes variations in the paper clamping force of the belts when the presser member 2 closes and clamps the sheets of paper 14. To prevent this, a tension roller 9*a* is disposed on the belt 10*b* of the presser member 2. The tension roller 9*a* is attached to a tension plate 8 together with a tension roller 9*b* so as to be rotatable about the shaft 7, and is forced downwards by a spring (not shown) to apply tension to the belt 10*b*. When the presser member 2 closes and clamps the sheets of paper 14, the amount of upward movement of the tension roller 9*a* varies depending on the thickness of the sheets of paper stacked. But at this time, the tension roller 9*b*, which is above the tension roller 9*a*, prevents loosening of the belt 10*b*. When the stacking of the sheets of paper 14 is in the state of FIG. 1, the presser member 2 turns in the direction of arrow P by the operation of the motor 5 and clamps the sheets of paper 14. This state is as shown in FIG. 3(*a*). At this time, if the motor 4 rotates in the forward direction, the belts 10*a* and 10*b* move in the direction of arrow R of FIG. 3*a* through the gears 11*a*, 11*b* and 11*c*, whereby the sheets of paper 14 are conveyed up to a delivery port 12, as in FIG. 3(*b*). If the user should forget to take the sheets of paper 14, the motor 4 rotates in the reverse direction, so that the belts 10*a* and 10*b* are moved in the direction of arrow L, whereby the sheets of paper 14 are conveyed reversely up to the position thereof shown in FIG. 3(*a*). Then, the motor 3 rotates in the forward direction to turn the tray 1 counterclockwise about the shaft 6 and stops in the position of FIG. 3(*d*). In this state, by rotating the motor 4 in the reverse direction, the sheets of paper 14 which the user forgets to take are received into a recovery box 15. When the recovery is over, the motor 3 rotates in the reverse direction to move the tray 1 back to the position shown in FIG. 3(*a*), then the motor 5 rotates in the reverse direction, so that the apparatus reverts to the state of waiting for stacking of sheets of paper 14, as shown in FIG. 1. If any trouble should occur with the sheets of paper 14 fed by the conveyor belt 13 due to the stacked feed thereof, the presser member 2 closes and clamps the sheets of paper 14. At the same time, the motor 3 rotates in the forward direction at once to turn the tray 1 counterclockwise up to its position shown in FIG. 3(*c*), then the motor 4 is rotated in the reverse direction to receive the sheets of paper 14 in a recovery box 16. After the end of the recovery, the tray 1 is moved back to its position shown in FIG. 3(*a*), and the motor 5 rotates in the reverse direction, so that the apparatus reverts to its state shown in FIG. 1.

According to this embodiment, an increase is attained in both the degree of freedom of the paper discharging direction and that of the position where the recovered paper storage portion is to be disposed, and it is not necessary to provide a special recovery path, thus reducing the size of the apparatus. It is also possible to construct the apparatus so that when it is necessary to send the paper 14 into either recovery box 15 or 16 after the paper has reached the paper delivery port 12, the tray 1 is tilted immediately for recovery of the paper. In this case, there is no fear of damage to the paper 14 at the time of the tilting because in this embodiment, the pivot shaft 6 is positioned near the paper delivery port 12.

Referring now to another embodiment of the present invention shown in FIGS. 7(*a*)–7(*e*), FIG. 7(*a*) shows the apparatus waiting for sheets of paper; 7(*b*) shows a state in which paper is clamped state; 7(*c*) shows a state in which the clamped sheets of paper have been conveyed to a paper delivery port, 7(*d*) shows a state in which a tray clamping the sheets of paper has been rotated to the position of a recovery box 15 about a tilting shaft 25, and 7(*e*) shows a state in which the tray has been rotated to the position of a recovery box 16. Although the tilting shaft 25 of the tray is different from that used in the previous embodiment, the function and effect of this embodiment are almost the same as in the previous embodiment.

As shown in the above embodiments, the for clamping sheets of paper on a tray as referred to herein is a complete set of devices for rotating the presser member 2 using the motor 5, including the belts 10*a*, 10*b* and gears 11*d*, 11*e*. And the device for conveying the sheets of paper forward or reverse while maintaining the clamped state as referred to herein indicates a complete set of driving devices for the belts 10*a*, 10*b*, using the motor 4, including the belts 10*a*, 10*b* and the gears 11*a*, 11*b*, 11*c*. Further, the device for tilting and stopping the device for clamping the sheets of paper on the tray in a plurality of stop positions except a paper delivery port in the clamped is both a drive control system and a device for tilting the tray 1, including the gears 11*f*, 11*g* and the motor 3.

What is claimed is:

1. In a paper conveying, discharging and recovering system including means for conveying sheets of paper stacked on a tray up to a paper delivery port and means for recovering said sheets of paper from said paper delivery port, the improvement characterized by further including means for clamping the sheets of paper stacked on said tray, means for selectively conveying the sheets of paper in a relatively forward or reverse direction while maintaining the clamped state, and means for tilting and stopping said clamping means in one of a plurality of stop positions different from said paper delivery port while in the clamped state.

2. A paper handling system as claimed in claim 1, wherein said plurality of stopped positions includes a first stop position at which said means for recovering said sheets of paper causes the sheets of paper to be conveyed to a recovery box.

3. A paper handling system as claimed in claim 2, further comprising means for receiving sheets of paper from said clamping means at said first stop position after said sheets of paper have been conveyed to said delivery port by said conveying means, wherein said receiving means comprises said recovery box.

4. A paper handling system as claimed in claim 2, further comprising means for receiving sheets of paper from said clamping means at said first stop position, wherein said tilting and stopping means includes means for stopping said clamping means at said first stop position after the sheets of paper have been prevented from being conveyed toward the paper delivery port, and wherein said receiving means comprises said recovery box.

5. A paper handling system as claimed in claim 1, wherein said plurality of stop positions includes first and second stop positions, and wherein said paper handling system further comprises means for receiving sheets of paper from said clamping means at said first stop position when said sheets of paper have been conveyed to said delivery port by said conveying means, and means for receiving sheets of paper from said clamping means at said second stop position when the sheets of paper have been prevented from being conveyed toward the paper delivery port.

6. A paper handling system, comprising:

a delivery port;

a first recovery box;

a conveyor unit;

a means for delivering paper to said conveyor unit;

wherein said conveyor unit selectively conveys sheets of paper to one of a plurality of destinations, said plurality of destinations including the delivery port and the first recovery box, said conveyor unit including a first conveyor belt for supporting one or more sheets of paper, a second conveyor belt for drivingly engaging said sheets of paper; clamping means for selectively applying clamping force to one of said conveyor belts relative to the other to clamp the sheets of paper therebetween, wherein said clamping means applies one of no clamping force and a first clamping force when sheets of paper are initially delivered to said conveyor unit by said means for delivering paper, and further applies a second clamping force different from the first clamping force when said conveyor unit is conveying sheets of paper; and means for driving said first and second conveyor belts in a first direction while in a clamping relationship to convey the clamped sheets of paper towards the delivery port when said conveyor unit is in a first position; and means for pivoting at least a portion of said conveyor unit from the first position about an axis to a second position so that said sheets of paper are conveyed to the first recovery box.

7. A paper handling apparatus as claimed in claim 6, wherein said plurality of destinations further includes a second recovery box, and wherein said conveyor unit conveys said sheets of paper to said first recovery box after the sheets of paper have been conveyed to the delivery port and remain at the delivery port beyond a predetermined time period, and to said second recovery box if the sheets of paper have been prevented from being conveyed to the delivery port.

8. A paper handling apparatus as claimed in claim 6, wherein the conveyor unit pivots so that the conveyor belts are driven in the first direction to convey the sheets of paper to the first recovery box.

9. A paper handling system as claimed in claim 6, further comprising means for reversing the driven direction of the conveyor belts so that, when the conveyor unit pivots, the conveyor belts are reversed and driven in a second direction opposite to the first direction to convey the sheets of paper to the first recovery box.

10. A paper handling system as claimed in claim 6, wherein the first and second conveyor belts are respectively arranged substantially in separate loops each having first and second ends, and wherein the clamping means includes means for bringing the respective second ends of the first and second conveyor belts relatively toward each other to achieve clamping force between the first and second belts.

11. A paper handling apparatus as claimed in claim 6, wherein the axis about which the conveyor unit portion pivots is located relatively away from the delivery port so that the conveyor unit portion pivots away from the delivery port.

12. A paper handling apparatus as claimed in claim 6, wherein the second clamping force is greater than the first clamping force.

13. A paper handling apparatus as claimed in claim 6, wherein the axis about which the conveyor unit portion pivots is located relatively adjacent to the delivery port so that the conveyor unit portion pivots toward the delivery port.

14. A paper handling apparatus as claimed in claim 13, wherein the driving means further comprises at least a first roller for enabling the first conveyor belt to be driven and a second roller for enabling the second conveyor belt to be driven, said rollers each having an axis about which it rotates, and wherein the pivoting axis is common to the axis of one of said rollers.

15. A paper handling apparatus as claimed in claim 14, wherein the pivot axis is the first roller axis.

16. A paper handling apparatus as claimed in claim 14, wherein the pivot axis is the second roller axis.

17. A paper handling apparatus as claimed in claim 6, wherein said first and second conveyor belts together form first and second conveyor belt portions, respectively, of a single conveyor belt.

18. A paper handling apparatus as claimed in claim 17, wherein the driving means further comprises at least a first roller for enabling the first conveyor belt portion to be driven and a second roller for enabling a second conveyor belt portion to be driven, said rollers each having an axis about which it rotates, and wherein the pivoting axis is common to the axis of one of said rollers.

19. A paper handling apparatus as claimed in claim 18, wherein the pivot axis is the first roller axis.

20. A paper handling apparatus as claimed in claim 18, wherein the pivot axis is the second roller axis.

* * * * *